US008781747B2

(12) United States Patent
Ziauddin

(10) Patent No.: US 8,781,747 B2
(45) Date of Patent: Jul. 15, 2014

(54) METHOD OF DETERMINING PARAMETERS OF A LAYERED RESERVOIR

(75) Inventor: Murtaza Ziauddin, Abu Dhabi (AE)

(73) Assignee: Schlumberger Technology Corporation, Sugar Land, TX (US)

( * ) Notice: Subject to any disclaimer, the term of this patent is extended or adjusted under 35 U.S.C. 154(b) by 249 days.

(21) Appl. No.: 12/480,894

(22) Filed: Jun. 9, 2009

(65) Prior Publication Data

US 2010/0307743 A1 Dec. 9, 2010

(51) Int. Cl.
*E21B 21/08* (2006.01)
*G01N 11/00* (2006.01)

(52) U.S. Cl.
USPC ..... 702/12; 702/45; 166/250.01

(58) Field of Classification Search
USPC ..... 702/45
See application file for complete search history.

(56) References Cited

U.S. PATENT DOCUMENTS

| | | | | |
|---|---|---|---|---|
| 3,905,226 | A | 9/1975 | Nicolas | |
| 4,799,157 | A | 1/1989 | Kucuk et al. | |
| 4,803,873 | A | 2/1989 | Ehlig-Economides | |
| 4,969,130 | A * | 11/1990 | Wason et al. | 367/73 |
| 5,305,209 | A * | 4/1994 | Stein et al. | 702/13 |
| 5,467,823 | A * | 11/1995 | Babour et al. | 166/250.01 |
| 5,586,082 | A * | 12/1996 | Anderson et al. | 367/73 |
| 5,602,755 | A | 2/1997 | Ashe et al. | |
| 5,642,051 | A * | 6/1997 | Babour et al. | 324/357 |
| 5,730,219 | A * | 3/1998 | Tubel et al. | 166/250.1 |
| 5,764,515 | A * | 6/1998 | Guerillot et al. | 702/2 |
| 5,777,278 | A * | 7/1998 | Bednarczyk et al. | 181/102 |
| 5,798,982 | A * | 8/1998 | He et al. | 367/73 |
| 5,803,167 | A * | 9/1998 | Bussear et al. | 166/65.1 |
| 5,829,520 | A * | 11/1998 | Johnson | 166/250.01 |
| 5,975,204 | A * | 11/1999 | Tubel et al. | 166/250.15 |
| 6,944,563 | B2 | 9/2005 | Melboet et al. | |
| 6,980,940 | B1 * | 12/2005 | Gurpinar et al. | 703/10 |
| 7,089,167 | B2 | 8/2006 | Poe | |
| 7,580,797 | B2 | 8/2009 | Akram et al. | |
| 2007/0295501 | A1 * | 12/2007 | Poulisse | 166/250.01 |
| 2009/0037113 | A1 | 2/2009 | Akram et al. | |
| 2010/0147066 | A1 | 6/2010 | Ziauddin | |

FOREIGN PATENT DOCUMENTS

WO WO2005075972 8/2005

OTHER PUBLICATIONS

International Search Report of PCT/US2010/037929 dated Dec. 22, 2010.

Ayestaran et al., "Layered Reservoir Testing," The Technical Review, Oct. 1987, pp. 4-11, 35(4).

Clark et al., "Analyzing Unstable Flow in Multilayer Gas Lift Wells With an Application of the Inflatable Diverter Flowmeter," SPE 20057, Apr. 4-6, 1990, pp. 371-382, 60th California Regional Meeting, Ventura, California, Society of Petroleum Engineers.

(Continued)

*Primary Examiner* — Jonathan C. Teixeira Moffat
*Assistant Examiner* — Regis Betsch
(74) *Attorney, Agent, or Firm* — David J. Groesbeck; Brandon S. Clark

(57) ABSTRACT

A method of determining parameters relating to the flow performance of subterranean sources is described using the steps of measuring a total flow rate and pressure at a reference datum for at least two different flow rates, allocating the flow from each of the sources using identified concentrations of characteristic components, and using the total flow rate, pressure and the allocation to determine selective inflow performance relationships for each source.

12 Claims, 5 Drawing Sheets

(56) References Cited

OTHER PUBLICATIONS

Da Prat et al., "A New Method for Evaluating Layer Productivity Using a Permanent Monitoring System," SPE 48865, Nov. 2-6, 1998, pp. 351-360, 1998 SPE International Conference and Exhibition, Beijing, China, Society of Petroleum Engineers.
Hegeman et al., "Production Logging for Reservoir Testing," Oilfield Review, Summer 1997, pp. 16-20.
Jackson et al., "Advances in Multilayer Reservoir Testing and Analysis using Numerical Well Testing and Reservoir Stimulation," SPE 62917, Oct. 1-4, 2000, 14 pages total, 2000 SPE Annual Technical Conference and Exhibition, Dallas, Texas, Society of Petroleum Engineers.
Stewart et al., "Well Performance Anaylsis: A Synergetic Approach to Dynamic Reservoir Description," SPE 10209, Oct. 5-7, 1981, 23 pages total, 56th Annual Fall Technical Conference and Exhibition of the Society of Petroleum Engineers of AIME, San Antonio, Texas, Society of Petroleum Engineers of AIME.
Sullivan et al., "Permeability from Production Logs—Method and Application," SPE 102894, Sep. 24-27, 2006, 16 pages total, 2006 SPE Annual Technical Conference and Exhibition, San Antonio, Texas, Society of Petroleum Engineers.

* cited by examiner

METHOD OF DETERMINING PARAMETERS OF A LAYERED RESERVOIR

FIELD OF THE INVENTION

The invention relates to methods of determining parameters characterizing the flow from or into different zones of a reservoir connected through one or more subterranean wells.

BACKGROUND

The production system of a developed hydrocarbon reservoir includes typically pipelines which combine the flow of several sources. These sources can be for example several wells or several producing zones or reservoir layers within a single well. To optimize production, it is often desirable to measure and monitor the inflow properties of each layer separately. The inflow properties include parameters such as the total liquid flow rate and static reservoir pressure.

Measurements of these properties have traditionally been performed using production logging tools such as Schlumberger's PLT™ disposed downhole on a cable (e.g., wireline, slickline) or other downhole conveyance tools.

Production logging is described in its various aspects in a large body of published literature and patents. The basic methods and tools used in production logging are described for example in the U.S. Pat. No. 3,905,226 to Nicholas and the U.S. Pat. No. 4,803,873 to Ehlig-Economides. Among the most advanced tools for production logging at present is the FlowScanner™ tool of Schlumberger.

By interpreting the results from production logging it is possible to determine the so-called Inflow Performance Relationships (IPRs), which give valuable information relating to formation pressure and near-wellbore formation damage (skin), optimal production pressures and flow rates, crossflow conditions and other important parameters. However in the presence of several formation layers or strata produced as comingled flow, comingling and crossflow between layers hinder conventional testing. In response to these difficulties, Selective Input Performance (SIP) testing has been developed.

In conventional SIP testing, production logging tools survey the well at different stabilized (pseudo-steady states) flow rates and at shut-in. An IPR curve is constructed for each layer by plotting pressure versus flow rate using data from two or more flow rates. These curves are then normalized to a reference hydrostatic pressure.

For further details on the measurement and known uses of inflow performance analysis, reference is made to U.S. Pat. No. 4,799,157 to Kucuk and Ayestaran, U.S. Pat. No. 4,803,873 to Ehlig-Economides, U.S. Pat. No. 7,089,167 to Poe and the Society of Petroleum Engineers (SPE) papers no. 10209, 20057, 48865 and 62917. Further reference to SIPs and their use can be found in the papers "Layered Reservoir Testing" by L. Ayestaran et al., in: The Technical Review 35, no. 4 (October 1987), 4-11 and "Production Logging for Reservoir Testing", by P. Hegeman and J. Pelissier-Combescure in: The Oilfield Review, Summer 1997, 16-20.

It is further known that oil samples can be analyzed to determine the approximate composition thereof and, more particularly, to obtain a pattern that reflects the composition of a sample known in the art as fingerprinting. Such geochemical fingerprinting techniques have been used for allocating comingled production from multilayered reservoirs.

There are many known variants of the fingerprinting methods. Most of these variants are based on using a physico-chemical method such as gas chromatography (GC), mass spectroscopy or nuclear magnetic resonance or others in order to identify individual components of a complex hydrocarbon mixture and their relative mass. In some known applications, combinations of gas chromatograph and mass spectroscopy (GC-MS) are used to detect spectra characteristic of individual components of the complex hydrocarbon mixture.

Using a physico-chemical method, typically a limited number of selected components are identified and quantified for use as geomarker molecules. With one or a set of such geomarkers being characteristic of the flow produced from a single source or layer, it is possible to allocated the flow from that layer in the comingled total flow. Geochemical fingerprinting methods are for example described in U.S. Pat. No. 5,602,755A to Ashe et al. and in the published International Patent Application WO 2005075972. Further methods of using compositional analysis for the purpose of back allocating well production are described in the U.S. Pat. No. 6,944,563 to Melbø et al.

In the light of the known methods it is seen as an object of the present invention to provide a novel method of determining selective inflow performance curves for individual sources or layers in a subterranean reservoir and using the SIPs thus determined to establish important reservoir parameters.

SUMMARY OF INVENTION

This invention relates to a method of determining parameters relating to the flow performance of subterranean sources using the steps of measuring total flow rate and pressure at a reference datum for at least two different flow rates, allocating the flow from each of the sources using identified concentrations of characteristic components, and using the total total flow rate and pressure and the allocation to determine selective inflow performance relationships for each source.

The selective inflow performance relationships can be used to determine the formation pressures at the location of the sources and/or the conditions and flow rates for crossflow between sources.

In a preferred embodiment, the step of allocating the flow from each of the sources uses knowledge of end member concentrations of the one or more components characteristic for the effluent of each of the sources. Geochemical fingerprinting can then be used advantageously to determine the allocation from surface samples of the total flow.

In another preferred embodiment, the reference datum for the pressure measurement is a subterranean location. From such a location, the pressures at other subterranean location can be determined using a standard model and knowledge of hydrostatic pressure differences and/or pressure losses caused by flow conditions.

It is further preferable to perform all measurements required to derive the SIPs from a single location at the surface without requirement of subsurface measurements. In a preferred variant of this embodiment, all measurements and sampling are performed at the location of the flowmeter. These surface measurements may by supported by prior subsurface measurements to measure or reduce the uncertainty in the determination of pressures and concentrations of geomarkers at the sources.

These and other aspects of the invention are described in greater detail below making reference to the following drawings.

DETAILED DESCRIPTION

Figure 1:
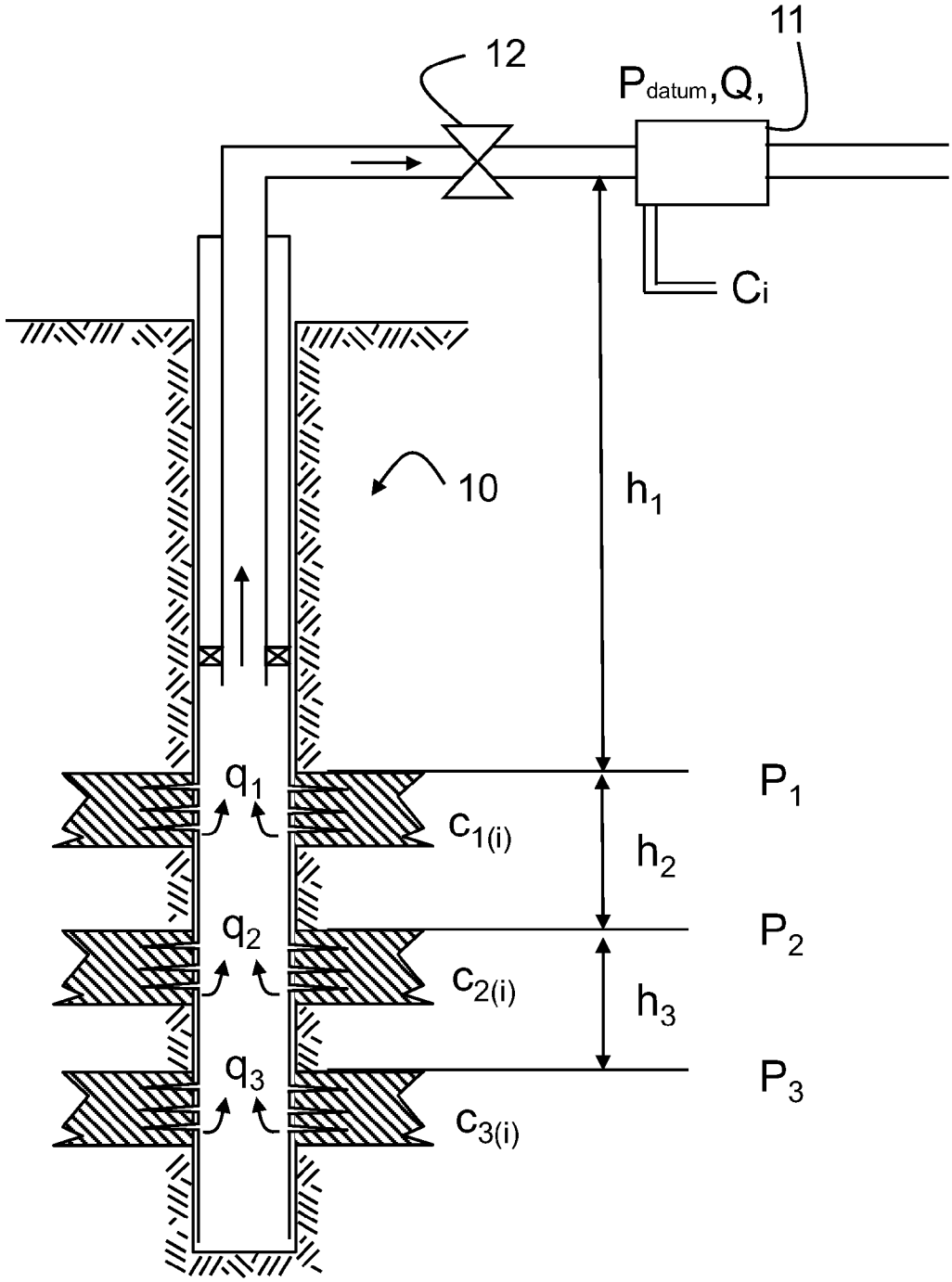
FIG. 1 illustrates an example of the invention applied to a reservoir with three producing layers.

The method is illustrated by the following example, in which FIG. 1 shows an oil well 10 drilled in a formation containing several oil-bearing sources. The term "source" is used synonymously with equivalent terms such as "layer", "zone" or "stratum". In this example, the number of separate sources is chosen to be three to allow for a clearer description of elements of the present invention. However, the number of sources can vary and the below described example is independent of any specific number of layers. The layers may not be linked by a single well as shown, but could be connected by several wells or branches of a well contributing to a single flow at a downstream location.

In the example, there is assigned to each layer a flow rate $q_1$, $q_2$, and $q_3$, respectively. The fluids produced of the three layers contain chemical components at concentrations $c_{1i}$, $c_{2i}$ and $c_{3i}$, respectively, wherein the index number i denotes a specific component i in the fluid. In the present example, the component i stands for any component selected as geomarker for later application of a back allocation through fingerprinting. Any number of such components or geomarkers can be chosen as long as they are identifiable in the surface sample and sufficient to distinguish the flow of one source from the others.

The pressures $P_1$, $P_2$ and $P_3$ are the flowing pressures in the wellbore at the top of the zone indicated by their respective subscripts and h1, $h_2$, and $h_3$ is used to denote the pressure differences between the layers as shown in FIG. 1.

Under normal production conditions, the combined flow is produced using subsurface and surface production facilities as shown in FIG. 1. On the surface, there is shown a device 11 to measure the flow rate Q of the combined flow and the combined or total concentration $C_i$ of component i. Though shown in the schematic drawing as one device, the measurements of Q and $C_i$ may be taken at different locations and even different times (provided the flow conditions are sufficiently stable).

The flow rates can be measured using any of the commercially available flowmeters such as Schlumberger's PhaseWatcher™. The flowmeter can be stationary or mobile. Schlumberger's PhaseWatcher is capable of measuring pressure and total flow rate of the flow and includes a bent section of pipe with a sampling port. The later can be used take samples or pass a sample stream representative of the total flow through a geochemical analyzer for measuring the concentrations $C_i$.

For the evaluation of the measurements, the present example of the invention makes use of basic equations which govern the transport of mass from the contributing sources or layers in the well to the point of measurement of the total flow. Using the notation as presented in FIG. 1, these can be expressed as:

$$\text{Mole/Mass balance: } q_1c_{1i}+q_2c_{2i}+q_3c_{3i}=QC_i, \quad [1]$$

constrained by the conservation of mass:

$$\text{Mass conservation: } q_1+q_2+q_3=Q. \quad [2]$$

The pressures at the respective layer level are related through the set of equations:

$$P_1=P_{datum}+h_1$$

$$P_2=P_{datum}+h_1+h_2$$

$$P_3=P_{datum}+h_1+h_2+h_3. \quad [3]$$

Figure 2:
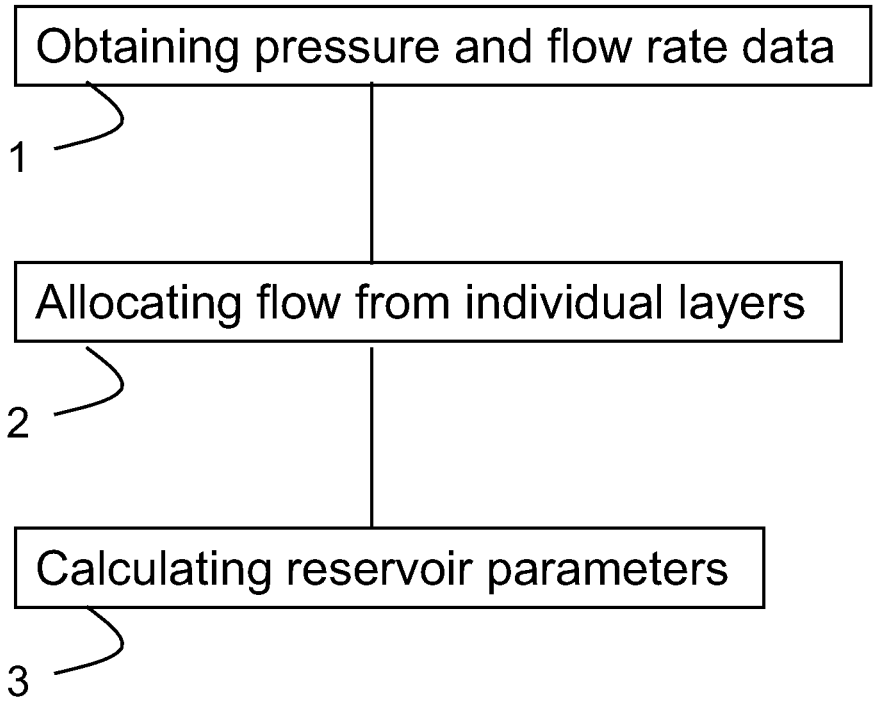
FIG. 2 summarizes steps accordance with an example of the invention used to determine the number of sources or producing layers.

In the following the steps of an example as shown in FIG. 2 are described in greater details making occasional reference to FIGS. 3 and 4.

In Step 1, using the flow meter a pressure is recorded for several flow rates (Q) in the well. The location of the pressure measurement $P_{datum}$ is referred to as the datum depth and can be chosen within a wide range of possible locations inside the well and on surface. In FIG. 1 pressure measurement is set at the location of the flow meter to take advantage of the capability of the flow meter to combine pressure and flow measurements. Alternatively the pressure may be measured by a stationary or mobile pressure gage in the well bore. While the surface is seen as a convenient location, a pressure gage may be located at a level just above the highest producing perforation or at the last entry point of formation fluid into the production tubing.

The flow rates can be globally changed by setting a surface choke valve 12. Again the production installation may allow for a change of the total flow rate at a different location or by using a different method. The measurements can serve as a basis to plot a total Inflow Performance Relationship (IPR) as shown in FIG. 3. It is worth noting that the example of an total IPR is presented for illustrative purposes only and not a necessary step for determining the Selective Input Relationships as described below. Generally, the IPR can be defined as representing a relation between a function of Q f(Q) and a function of $P_{datum}$ $f(P_{datum})$. The choice of these functions depends on the model used to represent the reservoir deliverability. In the simplest case as illustrated in FIG. 3, these functions can be reduced to f(Q)=Q and $f(P_{datum})=P_{datum}$. However for a gas reservoirs, $f(P_{datum})=P^2_{datum}$ is typically a better choice to produce an IPR.

Figure 3:
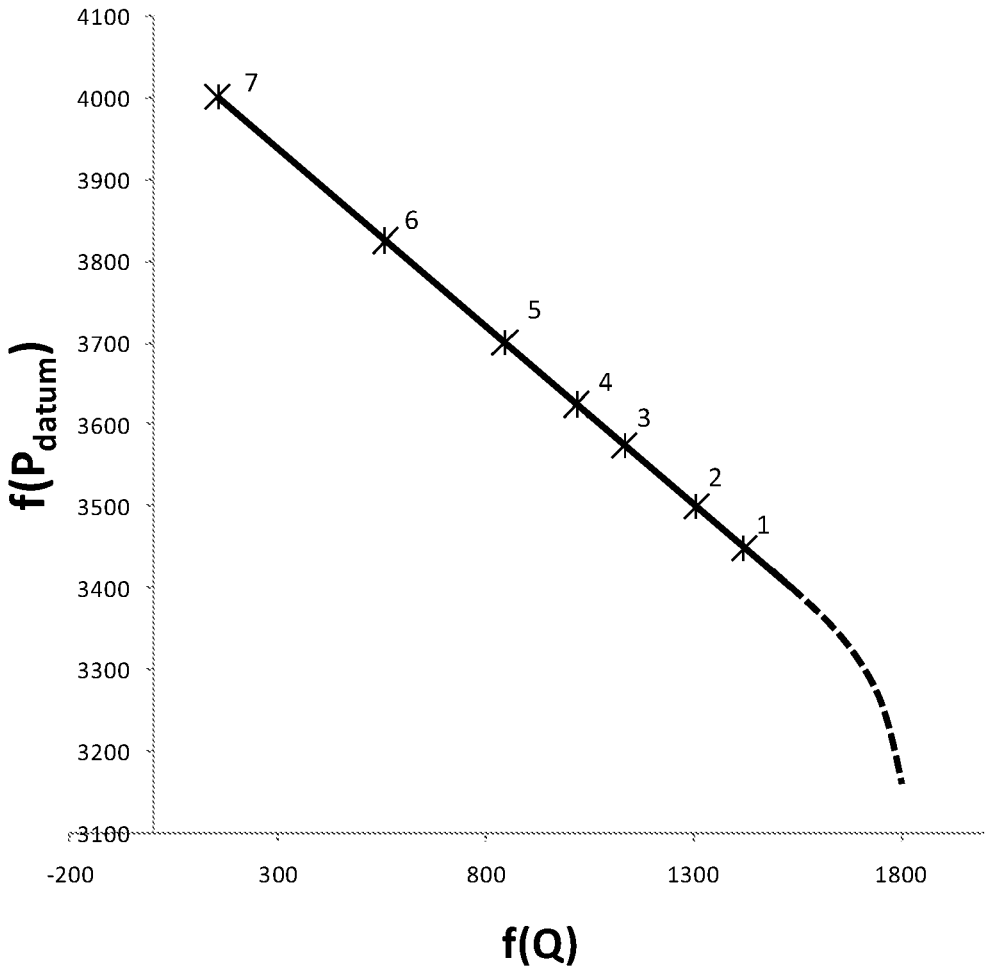
FIG. 3 is an example of inflow performance relationships as determined by methods proposed herein.

Whilst the measuring points for $P_{datum}$ and Q can be chosen in general arbitrarily across the range of possible values, it may be advantageous to start a series of such measurement with high enough flow rate, such that all zones have a positive contribution and the composite curve for f(Q) is linear (as shown on the FIG. 3). The flow rate can be altered in discrete steps and with each step in the flow rate the well should be allowed to return to a stable state before taking the data point. After a shut-in period prior to the test, a well is best cleaned-out and stabilized by letting the well produce at a high flow rate and wait until all transient behavior becomes negligible. The sampling of the comingled flow is also best performed close to the end of the flow period after the well reached a steady state. In the example, the comingled samples are collected from a sample outlet built into the flow meter at surface.

Flowing pressure for each zone ($P_1$, $P_2$ and $P_3$) and the pressure difference between zones ($h_1$, $h_2$ and $h_3$) can be calculated from $P_{datum}$ at surface (or any other chosen location and the hydrostatic pressure corrected if necessary by the pressure losses through flow effects, and other factors which can readily incorporated into a state model. The state model may be supported by any other known measurements such as earlier PLT measurements.

In Step 2 of FIG. 2, a method of flow allocation, such as geochemical fingerprinting is applied to allocate flow from each zone. For example concentration measurements can be performed in situ or by taking samples for subsequent analysis in a laboratory. The concentration measurement can be chemical but also isotopic. The concentration measurement itself can be based on optical, IR or mass spectroscopic, gas or other chromatographic methods or any other known method which is capable of discriminating between species and their respective amounts in the produced fluids. Though the exact method used to determine the concentrations is not a concern of the present invention, it appears that at the present state of art GC-MS or GC×GC provide the best results.

In accordance with known geochemical fingerprinting methods, the end member concentrations, $c_{1i}$, $c_{2i}$, and $c_{3i}$ of a component i in the fluid can be determined using commercially available formation testing or sampling tools and methods, such as Schlumberger's MDT™. When using these methods, the sampling tool is deployed downhole to sample each zone separately, thus rendering the process of analyzing the flows for the concentrations of potential geomarkers relatively straightforward. In place of an MDT logging, a PLT operation which yields the individual flow rates $q_i$ of the sources or layers can also be used to determine the individual concentrations $c_{1i}$, $c_{2i}$, and $c_{3i}$ by solving equation [1].

Other more complex methods, which however do not require a downhole measurement of the end member concentrations, are described in the co-owned U.S. patent application Ser. No. 12/335,884 filed Dec. 16, 2008, fully incorporated herein by reference. Following the latter methods, sufficient geomarkers are used to eliminate the unknowns of the resulting system of linear equations [1] and [2] even for an unknown number of sources. The advantage of this method is seen making the method exclusively surface based without the requirement for any downhole measurement.

Figure 4A:
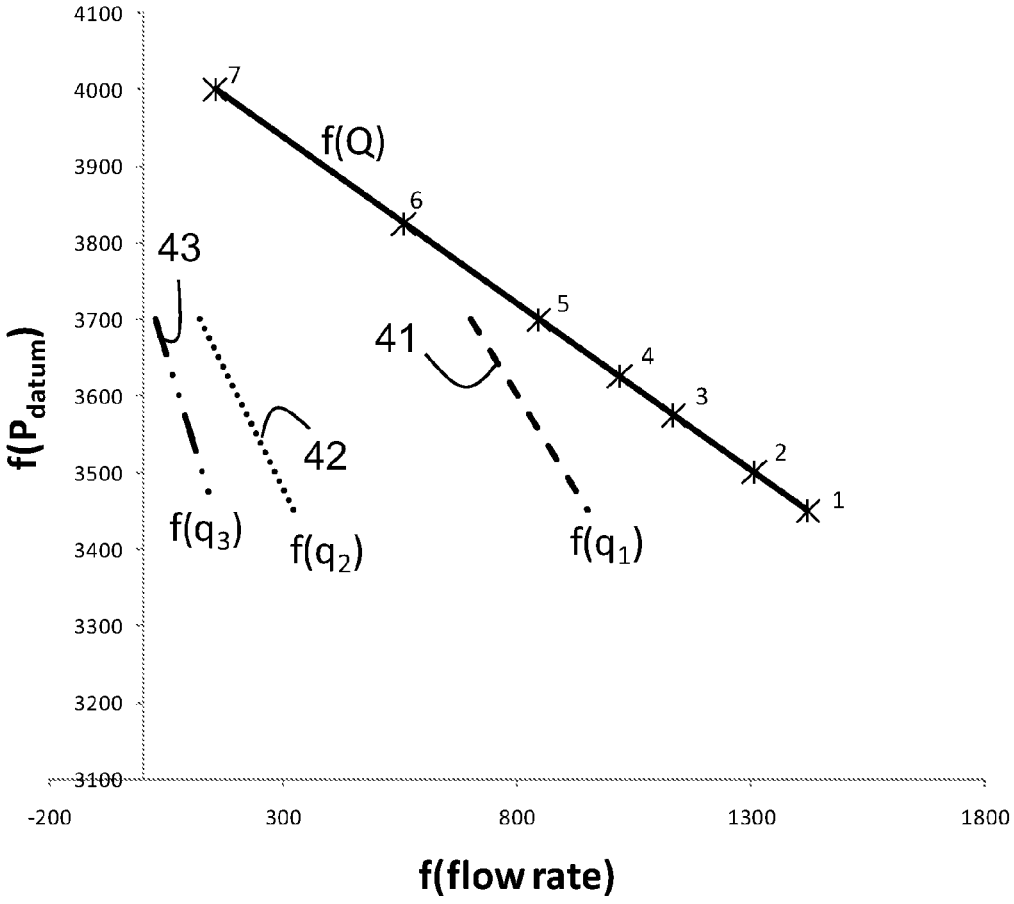
FIGS. 4A and 4B demonstrate parameters which can be derived from the inflow performance relationships.
Figure 4B:
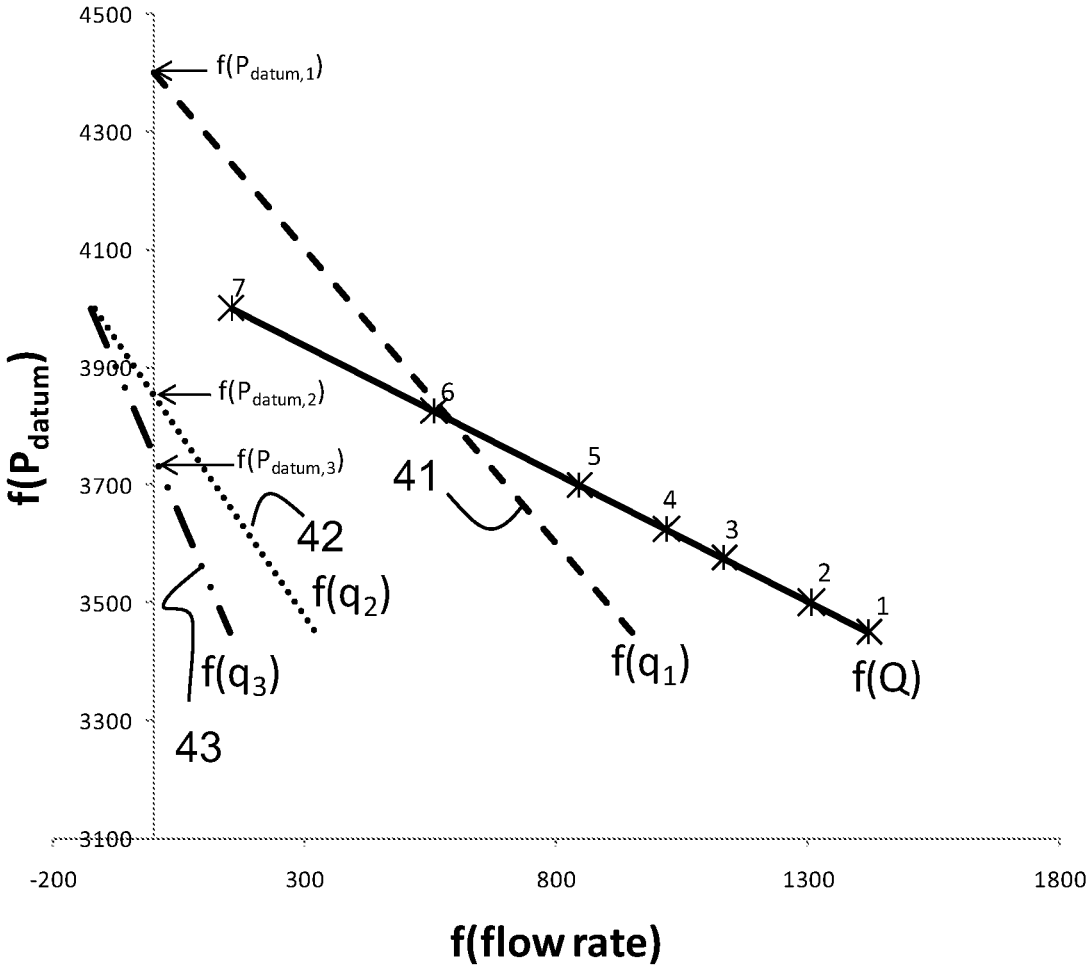

Once the zonal contributions to the total flow is known from the results of the allocation analysis, the zonal contribution for all values of total flow rate for which the zonal contribution is greater than zero can be plotted as shown in FIG. 4A to derive what is commonly referred to as Selective Inflow Performance relationships or SIP curves 41, 42, 43. Within the flow rate or pressure regime where the total IPR and SIPs are linear, a minimum of two data points are required otherwise more measurements are required to accurately reproduce the desired relationships. The productivity index for each layer can be calculated from the slope of their respective SIP relationship. Using the reduced functions $f(P_{datum})=P_{datum}$ and $f(q_1)=q_1$, $f(q_2)=q_2$ and $f(q_3)=q_3$, the productivity index for each zone is defined as the inverse of the slope of the curve for $P_{datum}$ vs the flow rate for each of the layers.

In Step 3 of FIG. 2, the Selective Inflow Performance (SIPs) for each individual zones 41, 42, 43 are used to determine the intercept of $f(q_1)$, $f(q_2)$, $f(q_3)$ with the $f(P_{datum})$ axis. The intercepts are indicated by $f(P_{datum,1})$, $f(P_{datum,2})$ and $f(P_{datum,3})$ in FIG. 4B. Reservoir pressure for each zone can be calculated using these intercepts. For example, if as above $f(P_{datum})=P_{datum}$ and $P_{r,1}$, $P_{r,2}$, $P_{r,3}$, are the reservoir pressure for zones 1, 2 and 3, then.

$$P_{r,1}=P_{datum,1}+h_1$$

$$P_{r,2}=P_{datum,2}+h_1+h_2$$

$$P_{r,3}=P_{datum,3}+h_1+h_2+h_3$$

Cross-flow in the well at any value of the total flow rate can be estimated by projection of $f(q_1)$, $f(q_2)$, $f(q_3)$ into the quadrant with negative flow rates, and reading of the appropriate flow rates. Using the relationships of FIG. 4B at a total flow of Q=155, the flow rates from the individual zones are $q_1=400$, $q_2=-120$ and $q_3=-125$ with the negative flow indicating an inflow into the respective zone.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative processes, one skilled in the art will recognize that the system may be embodied using a variety of specific procedures and equipment and could be performed to evaluate widely different types of applications and associated geological intervals. Accordingly, the invention should not be viewed as limited except by the scope of the appended claims.

What is claimed is:

1. A method of determining parameters relating to the flow performance of subterranean sources, comprising:

measuring a total flow rate and pressure at a reference datum for at least two different total flow rates, wherein the total flow rates comprise combined flows from at least two of the subterranean sources;

estimating a flow rate from at least one of the subterranean sources for each total flow rate using identified concentrations of characteristic components without relying on sensor information from the flows before they are combined, such characteristic components being sufficient to distinguish the flow of one subterranean source from the others; and using the total flow rates and the estimates to determine selective inflow performance relationships for the at least one subterranean source.

2. A method in accordance with claim 1, further comprising determining a formation pressure of at least one of the subterranean sources.

3. A method in accordance with claim 1, further comprising determining conditions and flow rates for crossflow between sources.

4. A method in accordance with claim 1, wherein estimating the flow from each of the at least one of the subterranean sources includes the step of sampling the flow at each different total flow rate.

5. A method in accordance with claim 1, wherein estimating the flow from each of the sources includes the step of determining end member concentrations of the one or more components.

6. A method in accordance with claim 1, wherein the reference datum for the pressure measurement is a subterranean location.

7. A method in accordance with claim 1, wherein the reference datum for the pressure measurement is a surface location.

8. A method in accordance with claim 4, wherein the measurement of the pressure and flow rate and sampling of the flow for analysis to identify concentrations of characteristic components are performed at a surface location.

9. A method in accordance with claim 4, wherein the pressure measurement and measurement of the flow rate are performed using a flow meter device capable of simultaneously determining pressure of the total flow and total flow rate and the sampling of the flow for analysis to identify concentrations of characteristic components is performed using a sampling port at said flow meter.

10. A method in accordance with claim 1, further using hydrostatic and/or flow corrections to determine pressures at the location of each of the sources from the measured pressure at the reference datum.

11. A method in accordance with claim 1, wherein sources are hydrocarbon producing zones or layers connected by production tubing.

12. A method of determining parameters relating to the flow performance of subterranean sources, comprising:

measuring a total flow rate at a first reference datum for at least two different total flow rates, wherein the total flow rate comprises a combined flow from at least two of the subterranean sources;

measuring a pressure of the total flow rate at a second reference datum;

estimating a flow rate from at least one of the subterranean sources at each total flow rate using identified concentrations of characteristic components and without sensor information from the flows from the subterranean sources before the flows are combined, such characteristic components being sufficient to distinguish the flow of one subterranean source from the others; and using said total flow rates and the estimates to determine selective inflow performance relationships for the at least one subterranean source.

* * * * *